United States Patent [19]

Tanikawa et al.

[11] Patent Number: 4,956,109

[45] Date of Patent: Sep. 11, 1990

[54] LUBRICATING OIL

[75] Inventors: Keiichi Tanikawa; Higaki Yuzo, both of Kanagawa, Japan

[73] Assignees: The Nisshin Oil Mills, Ltd.; Nippon Steel Corporation, both of Tokyo, Japan

[21] Appl. No.: 358,697

[22] Filed: May 26, 1989

[30] Foreign Application Priority Data

May 30, 1988 [JP] Japan ..... 63-130449

[51] Int. Cl.[5] ..... C10M 135/08; C10M 129/70

[52] U.S. Cl. ..... 252/48.6; 252/56 R; 252/79; 560/138; 560/255; 260/410.5; 260/402; 568/28; 568/31; 72/42

[58] Field of Search ..... 252/56 R, 48.6, 79; 560/138, 255; 260/410.5, 402; 568/28, 31

[56] References Cited

U.S. PATENT DOCUMENTS

| | | | |
|---|---|---|---|
| 2,640,848 | 6/1953 | Harman et al. | 252/48.6 |
| 3,477,974 | 11/1969 | Van Steveninck et al. | 260/410.5 |
| 3,504,022 | 3/1970 | Bresson | 568/31 |
| 3,586,529 | 6/1971 | Aronoff et al. | 260/410.5 |
| 3,594,340 | 7/1971 | Hollis et al. | 260/410.5 |
| 3,729,517 | 4/1973 | Bracke | 568/31 |
| 3,872,162 | 3/1975 | Radlove et al. | 260/410.5 |
| 4,198,305 | 4/1980 | Okorodudu | 252/48.6 |
| 4,539,128 | 9/1985 | Grossmann et al. | 252/56 R |

FOREIGN PATENT DOCUMENTS

| | | | |
|---|---|---|---|
| 2104202 | 8/1972 | Fed. Rep. of Germany | 260/410.5 |

*Primary Examiner*—Olik Chaudhuri

*Assistant Examiner*—Ellen M. McAvoy

*Attorney, Agent, or Firm*—Kane, Dalsimer, Sullivan, Kurucz, Levy, Eisele and Richard

[57] ABSTRACT

Herein disclosed is a lubricating oil comprising at least one member selected from the group consisting of esterified products obtained by reacting: (A) a compound selected from the group consisting of alcohols represented by the following general formula (I), alcohols represented by the following general formula (II) and hydrogenated derivatives thereof; with (B) a fatty acid having not less than 6 carbon atoms or a mixture of the fatty acid with a rosin selected from the group consisting of rosin, hydrogenated rosins, disproportionated rosins and polymerized rosins:

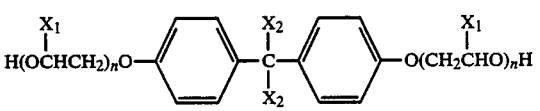

(I)

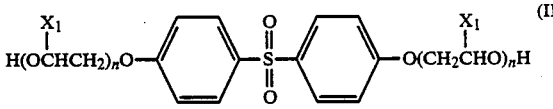

(II)

in the general formulas (I) and (II), $X_1$ and $X_2$ each independently represents a hydrogen atom or a methyl group and n is an integer ranging from 0 to 10. The lubricating oil is used as rolling mill oils, hydraulic oils cutting-grinding oils, lubricating oils for metal plastic working and those for internal combustion engines.

1 Claim, No Drawings

LUBRICATING OIL

BACKGROUND OF THE INVENTION

The present invention relates to an esterified product excellent in lubricating properties and the product can be used as metal working oils and metal plastic working oils such as rolling mill oils, cutting oils, grinding oils, drawing oils and press working oils. In particular, the present invention relates to a rolling mill oil having a low friction coefficient and excellent in pressure resistance under high pressure and high speed rotational conditions. In addition, the present invention further relates to a lubricant which shows excellent properties in metal plastic workings such as cutting working, grinding working, drawing working and press working of metals.

In recent years, the use conditions of lubricating oils have been more and more severer in response to a rapid development in various mechanical industries and hence superior lubricating properties have correspondingly been required for the oils.

Rolling mill oils conventionally used are roughly classified into the following three groups: oils and fats type rolling mill oils containing animal and/or plant oils and fats such as beef tallow, lard, palm oil and rape oil as base oils thereof; mineral oil type rolling mill oils and those comprising a mixture of mineral oils and oils and fats. In recent years, the development of high-speed rolling and high pressure rolling has been directed to further saving of energy and to improvement in the production efficiency. Rolling mill oils comprising animal and plant oils and fats as the base oils thereof are in general though to be suitable for a high-load and high-speed rolling, but there have practically been required for the development of rolling mill oils having further improved properties along with the recent development of techniques for rolling at a super-high-speed and under a super-high-pressure.

Moreover, if animal and plant oils and fats are used as the base oils in cold rolling working and a steel sheet subjected to such cold rolling is directly annealed without removing oil substances adhered to the surface of the steel sheet, the surface of the steel sheet is contaminated during the annealing process. On the other hand, if a rolling mill oil containing mineral oils as the base oils thereof is used, such rolling mill oils do not show high-speed and high-pressure rolling properties.

Although synthetic ester oils are recently developed (see, for instance, Japanese Patent Publication for Opposite Purpose (hereunder referred to as "J. P. KOKOKU") Nos. Sho 57-27156 and 60-54355; JANKATSU (Lubrication) 32, No. 2; and ibid 27, No. 8), the development of rolling mill oils having further improved properties have been desired taking into consideration rolling operations under more higher pressure and more faster rolling speed conditions.

On the other hand, the lubricants used in cutting working and grinding working of metals comprise a proper mixture of components selected, depending on purposes, from the group consisting of mineral oils, animal and plant oils and fats, extreme pressure additives, surfactants, antifoaming agents, anticorrosive agents for metals, antioxidants, antiseptics and antifungal agents. Cutting lubricants are usually used after diluting them 10 to 100 times with water, but water-insoluble cutting lubricants are also used in some cases.

The fundamental characteristics which cutting or grinding oils must have are lubricating properties, cooling properties, rust proof properties and other incidental conditions such as those free of foaming properties, hand-roughening properties, toxicity to men and beasts and giving out of bad smells. Although cutting or grinding oils are varied in the manner of laying stress on what properties they should have, depending on their use purposes and use conditions, they must have the aforementioned properties in a well-balanced manner. However, conventional cutting or grinding oils could not satisfy the aforementioned conditions.

SUMMARY OF THE INVENTION

It is an object of the present invention to provide a synthetic lubricant whose lubricating oil components have molecular structures designed to impart superior lubricating characteristics to the lubricant, which meet the recent substantially severe use conditions of lubricating oils and more specifically, to provide a lubricant which has high lubricating properties and a high stability and which infrequently causes deterioration due to microorganisms and is less perishable.

Another object of the present invention is to provide a cold rolling mill oil for steels which contributes to improvement in the production efficiency such as energy saving and simplification of steps; is stable to heat or mechanical shear generated at a high speed or under a high pressure; and is also stable to chemical reactions such as oxidation, decomposition and polymerization.

A still further object of the present invention is to provide a cutting or grinding oil which has excellent lubricating properties, cooling properties and rust proof properties; raises no problem of foaming, hand-roughening and toxicity to men and beasts and is less perishable.

According to the present invention, there is provided a lubricating oil which comprises at least one member selected from the group consisting of esterified products obtained by reacting:

(A) a compound selected from the group consisting of alcohols represented by the following general formula (I), alcohols represented by the following general formula (II) and hydrogenated derivatives thereof; with (B) a fatty acid having not less than 6 carbon atoms or a mixture of the fatty acid with a rosin selected from the group consisting of rosin, hydrogenated rosins, disproportionated rosins and polymerized rosins:

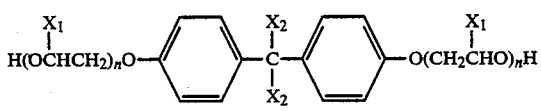

(I)

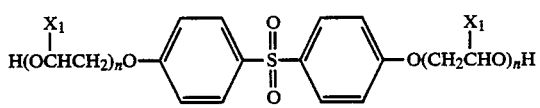

(II)

In the general formulas (I) and (II), $X_1$ and $X_2$ each independently represents a hydrogen atom or a methyl group and n is an integer ranging from 0 to 10.

DETAILED DESCRIPTION OF THE INVENTION

Examples of the alcohols represented by formula (I) include bisphenol A (4,4'-dihydroxydiphenyl-2,2-propane), bisphenol F (dihydroxydiphenyl methane), hydrogenated derivatives thereof and polyether polyols obtained by adding a desired amount of ethylene oxide or propylene oxide to such bisphenols and their derivatives, and examples of the alcohols represented by formula (II) include bisphenol S (4,4'-dihydroxyphenyl sulfone), hydrogenated derivatives thereof and sulfur-containing alcohols obtained by adding a desired amount of ethylene oxide or propylene oxide to such a bisphenol and its derivatives.

Regarding the polyols represented by formulas (I) and (II) and their hydrogenated derivatives, n is preferably an integer ranging from 0 to 10 as defined above. This is because if n is at least 11, the molecular weight of the polyols or derivatives thereof becomes extremely high, the number of ether bonds included therein is also increased and correspondingly the lubricating properties thereof decreases. In this respect, the number n denotes an average molar number of ethylene oxide or propylene oxide added. If n is 10, the added molar number of ethylene oxide or propylene oxide has a distribution and, in some cases, there are observed alcohols having a number n of more than 10. Strictly speaking, n is an averaged number and preferably not more than 10.

As the fatty acids, there may be mentioned such fatty acid having at least 6 carbon atoms as hexanoic acid, octanoic acid, decanoic acid, lauric acid, myristic acid, palmitic acid, stearic acid, arachic acid, behenic acid, montanic acid, palmitooleic acid, oleic acid, erucic acid, ricinolic acid, hydroxystearic acid, linolic acid, linoleic acid, isooctylic acid, isodecanoic acid, isolauric acid, isomyristic acid, isopalmitic acid, isostearic acid and isoarachic acid. In addition to these examples, natural fatty acids such as lanolin fatty acids, fish oil fatty acids, soybean oil fatty acids, coconut fatty acids, beef tallow fatty acids, and hydrogenated derivatives thereof may also be employed as such fatty acids. If fatty acids having not more than 5 carbon atoms are used, the lubricating properties of the resulting lubricating oil are impaired.

On the other hand, regarding the upper limit, the number of carbon atoms of the fatty acids used herein is not critical, but preferably the number of carbon atoms is not more than 30 since such fatty acids are commercially available at a low price.

The rosins herein used may be those generally known and examples thereof include tall oil rosins, gum rosins and wood rosins.

The hydrogenated rosins are those obtained by hydrogenating such rosins as those listed above. The term "disproportionation" as used in the term "disproportionated rosin" in general means that some of molecules among the same compound are reduced while the other of the molecules are oxidized. However, the disproportionated rosin herein means, like the hydrogenated rosins, rosins whose molecules constituting the same such as abietic acid or pimaric acid are reduced. Moreover, polymerized rosins are rosin compounds having a high molecular weight (polymers) which are formed from at least two rosins (monomers) chemically bonded together.

The mixing ratio of the fatty acids and the rosins when they are used as a mixture thereof is preferably in the range of from 95:5 to 25:75 expressed in the weight ratio from the viewpoint of lubricating properties and more preferably ranges from 90:10 to 40:60.

Methods for preparing the esterified compounds of the present invention are not restricted to specific ones and these compounds may be prepared by carrying out the esterification reaction in the presence or absence of a catalyst according in a common manner.

The synthetic ester lubricants of the present invention can be applied to a wide variety of applications as plastic working oils for metals and lubricating oils for machinery such as cutting and grinding oils, press working oils and rolling mill oils. The rolling mill oils for steels comprising, as a main component, the synthetic ester of the present invention permits the rolling of steel sat high speed and high pressure conditions. Moreover, since the cold rolling mill oil shows mill cleanability, it makes it possible to roll a thin steel plate and to directly anneal the steel plate without degreasing it after rolling the same. In addition, the synthetic ester of the present invention may be used as a principal component of lubricants for cutting or grinding and can impart, to the lubricants, lubricating properties, cooling properties, rust proof properties and those free of foaming properties, hand-roughening properties, toxicity to men and beasts and giving out of bad smells.

If the synthetic ester of the present invention is used as an ingredient of rolling mill oils, cutting-grinding oils, lubricating oils for plastic working of metals such as drawing working and press working and internal combustion engine oils, the synthetic esters may be used alone or in combination with other base oils such as mineral oils, animal and plant oils and fats and/or known synthetic esters generally employed. An emulsifying agent may be added thereto to form an emulsion depending on the purposes. Alternatively, these may be used as self-emulsifiable lubricants through, in particular, increasing the molar number of added ethylene oxide. The synthetic esters may be used in combination with emulsifying agents, fatty acids, antioxidants, anticorrosive agents, antiseptics and antifungal agents which are commonly used as additives for practically used conventional lubricating oils.

If the synthetic ester compounds of this invention are used in combination with other base oils or the like, a desired effect can be achieved by using the ester compound of this invention in an amount of not less than 1% by weight, but a lubricating oil having stable properties can be obtained if the ester compound is used in an amount of not less than 5% by weight. An example of preparation of such an ester will be explained below.

Preparation Example

To a 4-necked flask equipped with a stirrer, a thermometer, a tube for blowing nitrogen gas thereinto and a separator for water there were charged 288 g of an adduct of bisphenol A with 2 moles of ethylene oxide (New-col 1900; available from NIPPON EMULSIFYING AGENT MANUFACTURING CO., LTD.) AND 585 g of isostearic acid #871 (available from EMERY Company) followed by adding 0.5 g of phosphoric acid as a catalyst, adding xylene as a refluxing solvent in an amount of 5% of the total charged amount, sufficiently stirring the mixture and continuing the reaction of the mixture at 180° to 230° C. till the predetermined amount of water was distilled off. It took 5 hours to complete the reaction. After the completion of the reaction, xylene was distilled off under a reduced pressure and the residue was decolorized and filtered through a layer of activated clay to thus obtain a yellow liquid. The yield of the product was 768 g and the acid value of the product was 2.1 (Sample B).

According to the same manner as described above, synthetic esters were prepared. The properties or the like of the resulting synthetic esters are summarized in the following Tables I and II.

TABLE I

Esterified pRODUCTS Obtained from Alcohols of Formula (I)

| Sample | Kind of Alcohol $X_1$ | $X_2$ | n | Hydrogenated or Non-Hydrogenated | Kind of Fatty Acid | Kind of Rosin | Alcohol/Fatty Acid/Rosin Reaction Molar Ratio | General Properties of Ester Acid Value | Viscosity (CPS/50° C.) |
|---|---|---|---|---|---|---|---|---|---|
| A | H | $CH_3$ | 0 | Non-hydrogenated | isooctylic acid | — | 1/2 | 1.2 | 85 |
| B | H | $CH_3$ | 1 | " | isostearic acid | — | 1/2 | 2.1 | 95 |
| C | H | H | 5 | " | coconut fatty acid | tall oil rosin | 1/1.5/0.3 | 4.1 | 980 |
| D | H | $CH_3$ | 10 | " | beef tallow fatty acid | — | 1/2 | 1.5 | 195 |
| E | $CH_3$ | $CH_3$ | 1 | " | isostearic acid | — | 1/2 | 2.2 | 103 |
| F | $CH_3$ | H | 4 | " | fish hardened oil fatty acid | — | 1/2 | 1.8 | 135 |
| G | H | $CH_3$ | 1 | Hydrogenated | palmitic acid | dispro-portion-ated rosin | 1/1.4/0.4 | 3.3 | 1220 |

TABLE II

Esterified Products Obtained from Alcohols of Formula (II)

| Sample | Kind of Alcohol x | n | Hydrogenated or Non-Hydrogenated | Kind of Fatty Acid | Kind of Rosin | Alcohol/Fatty Acid/Rosin Reaction Molar Ratio | General Properties of Ester Acid Value | Viscosity (CPS/50° C.) |
|---|---|---|---|---|---|---|---|---|
| H | H | 0 | Non-hydrogenated | isostearic acid | — | 1/2 | 1.9 | 470 |
| I | H | 2 | " | beef tallow fatty ACID | gum rOSIN | 1/1.2/0.6 | 4.3 | 1950 |
| J | $CH_3$ | 1 | Hydrogenated | coconut oil fatty acid | — | 1/2 | 1.2 | 260 |
| K | $CH_3$ | 8 | Non-hydrogenated | fish hardened oil fatty acid | — | 1/2 | 2.8 | 370 |
| L | H | 1 | Hydrogenated | isostearic acid | — | 1/2 | 2.2 | 420 |

EXAMPLE 1:

Test on General Properties of the Synthetic Ester Compounds (Lubricating Oils) in the Metal Plastic Working:

The test results of the properties of the lubricating oil of the present invention were compared with those of conventional lubricating oils and the results obtained were shown in Table III given below.

The friction coefficient and anti-galling properties were determined by means of Bowden tester and the heat resistance was determined by means of a thermobalance.

<Test by Means of Bowden Tester>

Various sample lubricants were applied to the surface of a low carbon steel sheet and the coated surface was pressed by a steel ball of 3/16 inch diameter under a load of 3 kg (hertz pressure: 223 kg/mm$^2$). The ball was then slided in reciprocating manner at a rate of 4 mm/sec to determine the number of times of sliding (anti-galling properties) at which the friction coefficient of the coated lubricants reached 0.15.

<Test by Means of Thermobalance>

A sample lubricant (35 mg) was introduced into a platinum crucible, followed by gradually heating it at a rate of 5° C. per minute in He gas atmosphere and determining the heating temperature at which the sample lubricant decomposed and burnt off.

In the Bowden test, the test was performed under plastic working conditions of steel sheet as close to the actual ones as possible; the test temperature was set up at 200° C. taking into consideration the heat generation due to plastic deformation; and as the steel sheet, a mild steel sheet which easily caused plastic deformation was used.

The friction coefficient corresponds to the power required at the time of actual working and the anti-galling properties correspond to the occurrence of galling marks and the life of tool.

Moreover, in the test by means of thermobalance, it can be said that the higher the temperature at which the sample lubricant burns off, the better the heat resistance.

TABLE III

| | Sample Lubricant | | | Test Results | | |
|---|---|---|---|---|---|---|
| | Sample | Amount Incorporated (% by weight) | Other Substances Incorporated (wt %) | Friction Coefficient | Anti-galling properties (times) | Heat Resistance (°C.) |
| Lubricant of This Invention | A | 100 | — | 0.070 | 61 | 385 |
| | B | 100 | — | 0.055 | 78 | 440 |
| | C | 100 | — | 0.055 | 81 | 460 |
| | D | 100 | — | 0.065 | 75 | 440 |
| | E | 100 | — | 0.050 | 83 | 450 |
| | F | 100 | — | 0.050 | 81 | 450 |
| | G | 100 | — | 0.055 | 88 | 465 |
| | H | 100 | — | 0.055 | 85 | 450 |
| | I | 100 | — | 0.050 | 87 | 450 |
| | J | 100 | — | 0.050 | 85 | 450 |
| | K | 100 | — | 0.060 | 82 | 450 |
| | L | 100 | — | 0.045 | 91 | 465 |
| | B | 30 | 65% Machine Oil + 5% Stearic Acid | 0.065 | 72 | 425 |
| | C | 40 | 55% Machine Oil + 5% Stearic Acid | 0.060 | 75 | 425 |
| | L | 20 | 50% Machine Oil + 27% Octyl Stearate + 3% Stearic Acid | 0.060 | 73 | 425 |
| | J | 50 | 45% Machine Oil + 5% Stearic Acid | 0.065 | 71 | 430 |
| Conventional Lubricant | | | Machine Oil | 0.120 | 4 | 355 |
| | | | Stearic Acid | 0.070 | 11 | 360 |
| | | | Beef Tallow Oil | 0.065 | 26 | 430 |
| | | | 35% Machine Oil + 35% Beef Tallow Oil + 30% Octyl Stearate | 0.080 | 29 | 400 |

EXAMPLE 2:

Lubricating Oils for Rolling:

With a mineral oil or palm oil commonly used as a base oil for practical oils for rolling were blended together an emulsifying agent, a fatty acid and an anti-oxidant, commonly used as additives and the synthetic ester of the present invention to prepare oil compositions for rolling, and lubricating properties and annealing properties of the compositions were evaluated.

An emulsion rolling was carried out by means of a two-high rolling mill, with a rolling material (spcc: 1.2×20×200 mm) and under condition of the content of an oil component of 3% and a bath temperature of 50° C., and a rolling load at a rolling reduction of 40% was determined to evaluate the rolling lubricating properties. Further, as to the annealing properties, a steel sheet rolled with a sample emulsion was heaped up, as it was, in a number of several tens of sheets, followed by fixing these sheets with a steel band having a small width and annealing them in a small-sized annealing oven.

As to the heating conditions at the time of the annealing, the steel sheets were heated to 600° C. in a stream of HNX gas ($H_2$:5%) at a flow rate of 120 ml/min and at a rate of heating of 10° C./min, followed by maintaining the temperature at 600° C. for one hour, then allowing it to cool down, thereafter applying a cellophane tape onto the steel surface to collect the matter attached thereto, applying the resulting tape onto a sheet of white paper to judge the extent of stains visually to thus evaluate the surface cleanability of the steel sheet. The test results are summarized in Table IV given below. In this Table, symbols used are the same as those defined in Tables I and II.

TABLE IV

| | Emulsion(5) | | | | | |
|---|---|---|---|---|---|---|
| | Comp. | Synthetic Ester (content: 45%) | | | | |
| | Ex. 1 | B | E | G | H | L |
| Composition* of Rolling Oil | | | | | | |
| Mineral Oil | 55 | 50 | 50 | 50 | 50.5 | 50.5 |
| Palm Oil | 40 | — | — | — | — | — |
| Palmitic Acid | 2.5 | 2 | 2 | 2 | 2 | 2 |
| Anti-Oxidant(1) | 1 | 1 | 1 | 1 | 1 | 1 |
| Emulsifying Agent(2) | 1.5 | 2 | 2 | 1.5 | 1.5 | 1.5 |
| Ratio of Rolling Load(3) (lubricating Properties) | 1.00 | 0.88 | 0.90 | 0.85 | 0.85 | 0.86 |
| Annealing Properties(4) | X~Δ | ○~◎ | ○ | Δ~○ | Δ~○ | ○ |

*The composition of rolling oils is expressed in "% by weight".
(1)Antioxidant: 2,6-tert-butyl-4-methylphenol.
(2)Emulsifying agent: polyoxyethylene alkylphenyl ether (HLB: 11.7).
(3)Ratio of rolling loads: This is expressed in a value relative to that of Comparative Example 1.
(4)The surface cleanability of steel sheets was evaluated according to the following four-stage evaluation: ◎no stain; ○very slightly stained; Δ stained; and X severely stained.
(5)The content of each synthetic ester (B to L): 45%; and the oil content of the practically used emulsion: 3%.

EXAMPLE 3

Cutting-Grinding Oils

The results on durability tests, four-ball lubricating properties tests and alpha-model lubricating properties tests of the cutting oils (sample Nos. 1 to 4) into which the esterified products of the present invention were incorporated are summarized in the following Table V. Samples No. 5 and No. 6 are commercially available cutting oils.

TABLE V

| Sample No. | Composition (wt %) | | Note 1 Durability Test | Note 2 Pressure Resistance ($kg/cm^2$) | Note 3 Galling Load (Kg) | Note 3 Wear Width (mm) |
|---|---|---|---|---|---|---|
| 1 | Sample A | 40% | No change | >19 | >315 | 2.4 |
| | Liquid Paraffin | 60% | Flowable | | | |
| 2 | Sample C | 40% | No change | >22 | >315 | 2.0 |
| | Liquid Paraffin | 60% | Flowable | | | |
| 3 | Sample J | 40% | No change | >24 | >315 | 2.1 |
| | Liquid Paraffin | 60% | Flowable | | | |
| 4 | Sample I | 40% | No CHANGE | >23 | >315 | 2.0 |
| | Liquid Paraffin | 60% | Flowable | | | |
| 5 | Commercially Available Widely Used Products | | Hardened like Varnish | 15 | 160 | 5 |
| | Spindle Oil | 90% | | | | |
| | Fatty Oil Content | 10% | | | | |
| 6 | Commercially Available Widely Used Products | | Changed to Dark Brown | 15 | >315 | 3.5 |
| | Spindle Oil | 93% | Flowable | | | |
| | Fatty Oil Content | 5% | | | | |
| | Chlorine Content | 2% | | | | |

Note 1 A cold-rolled steel sheet was dipped in a sample oil, followed by pulling up it, allowing it to stand still horizontally at an indoor place near a window where direct sunlight is not shined, and observing its condition.
Note 2 Using a SOTA-type four-ball tester according to JIS K 2519 and applying loads each at a rate of 0.5 $kg/cm^2$ per min. at 220 rpm, the lubricating properties of the cutting oils of the present invention were compared with those of commercially available cutting oils.
Note 3 Using an alpha-model LFW-1 type tester according to ASTM D 2714, and applying loads each at a rate of 15 kg/min. at 300 rpm and 110° F. up to 315 kg, the wear width of the resulting specimen and the seizing load were determined.

The synthetic ester compounds of the present invention obtained from an alcohol and a fatty acid; or an alcohol, a fatty acid and a rosin are substantially superior, in lubricating properties and stability, to conventional lubricating oils and, therefore, they can effectively be used as rolling oils, hydraulic oils, cutting-grinding oils, lubricating oils for metal plastic working and those for internal combustion engines.

For instance, the rolling mill oils comprising the synthetic ester compounds of the present invention can enhance the rolling lubricating properties of steel sheets higher than that attained by conventional cold rolling mill oils comprising existing synthetic esters. Thus energy saving such as reduction in the power cost and resources-saving effect are brought about. Further, the oils are also excellent in annealing properties, makes it possible to omit conventional electrolytic degreasing operations and to thus reduce the cost of equipments.

Moreover, if the ester compounds of this invention is used as cutting or grinding oils, they show excellent lubricating properties and substantially satisfy various use conditions such as stability and are free of giving out of bad smells.

In addition, at the time of working lubrication, sufficient lubrication is ensured even under severe conditions such as high-speed working and the lubricating oils of this invention make the working more smooth and efficient.

The lubricating oils of the present invention further make it possible to prevent the lowering of quality (such as the formation of seizing marks) of products which is caused due to insufficient lubrication; to prevent wear or breakage of working tools; to enhance the quality of products; and to greatly extend the life of tools.

Furthermore, the lubricating oils of the present invention provide many excellent effects such as reduction in the power required during working and great promotion of resources-saving and energy-saving.

What is claimed is:

1. A lubricating oil comprising at least one member selected from the group consisting of esterified products obtained by reacting: (A) a compound selected from the group consisting of alcohols represented by the following general formula (I), alcohols represented by the following general formula (II) and hydrogenated derivatives thereof; with (B) a fatty acid having not less than 6 carbon atoms or a mixture of the fatty acid with a rosin selected from the group consisting of rosin, hydrogenated rosins, disproportionated rosins and polymerized rosins:

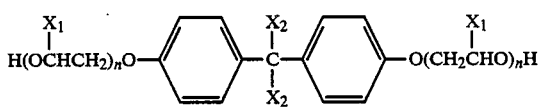

(I)

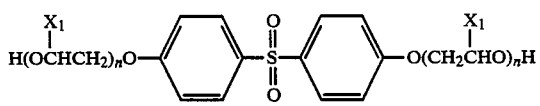

(II)

in the general formulas (I) and (II), $X_1$ and $X_2$ each independently represents a hydrogen atom or a methyl group and n is an integer ranging from 0 to 5.

* * * * *